United States Patent [19]

Stiefel et al.

[11] Patent Number: 5,018,741

[45] Date of Patent: May 28, 1991

[54] GOLF BALL

[75] Inventors: Joseph F. Stiefel, Shrewsbury; R. D. Nesbitt, Westfield, both of Mass.; Terence Melvin, Somers, Conn.

[73] Assignee: Spalding & Evenflo Companies, Inc., Tampa, Fla.

[21] Appl. No.: 384,205

[22] Filed: Jul. 24, 1989

[51] Int. Cl.[5] ..... A63B 37/14

[52] U.S. Cl. ..... 273/232; 273/213

[58] Field of Search ..... 273/232, 235 R, 220, 273/62, 218; 40/327

[56] References Cited

U.S. PATENT DOCUMENTS

| | | | |
|---|---|---|---|
| 3,819,190 | 6/1974 | Nepela et al. | 273/232 |
| 4,090,716 | 5/1978 | Martin et al. | 273/232 |
| 4,141,559 | 2/1979 | Melvin et al. | 273/220 |
| 4,142,727 | 3/1979 | Shaw et al. | 273/232 |
| 4,235,441 | 11/1980 | Ciccarello | 273/213 |
| 4,256,304 | 3/1981 | Smith et al. | 273/60 B |
| 4,258,921 | 3/1981 | Worst | 273/232 |
| 4,266,773 | 5/1981 | Treadwell | 273/232 |
| 4,346,898 | 8/1982 | Badke | 273/232 |
| 4,560,168 | 12/1985 | Aoyama | 273/232 |
| 4,653,758 | 3/1987 | Solheim | 273/232 |
| 4,660,834 | 4/1987 | Carrigan | 273/176 AB |
| 4,681,323 | 7/1987 | Alaki et al. | 273/232 |
| 4,720,111 | 1/1988 | Yamada | 273/232 |
| 4,722,529 | 2/1988 | Shaw et al. | 273/232 |
| 4,729,567 | 3/1988 | Oka et al. | 273/232 |
| 4,729,861 | 3/1988 | Lynch et al. | 264/219 |
| 4,744,564 | 5/1988 | Yamada | 273/232 |
| 4,762,326 | 8/1988 | Gobush | 273/232 |
| 4,765,626 | 8/1988 | Gobush | 273/232 |
| 4,772,026 | 9/1988 | Gobush | 273/232 |
| 4,787,638 | 11/1988 | Kobayashi | 273/232 |

*Primary Examiner*—George J. Marlo

*Attorney, Agent, or Firm*—Donald R. Bahr; John E. Benoit

[57] ABSTRACT

A golf ball is disclosed which has two poles and an equator and a modified icosahedral lattice wherein the lattice comprises five adjacent triangles on either side of the equator, with the vertices of each of the adjacent triangles being located at each of the poles and the legs of the triangles opposite said vertices being equidistantly spaced from the equator. Each triangle includes four dimples having a diameter D1 and two dimples having a diameter D2 located substantially centrally within the triangles. The remaining surface of the ball, including the remaining area within the triangles, contains dimples having a diameter D3. The diameter relationship is D1>D2>D3.

6 Claims, 4 Drawing Sheets

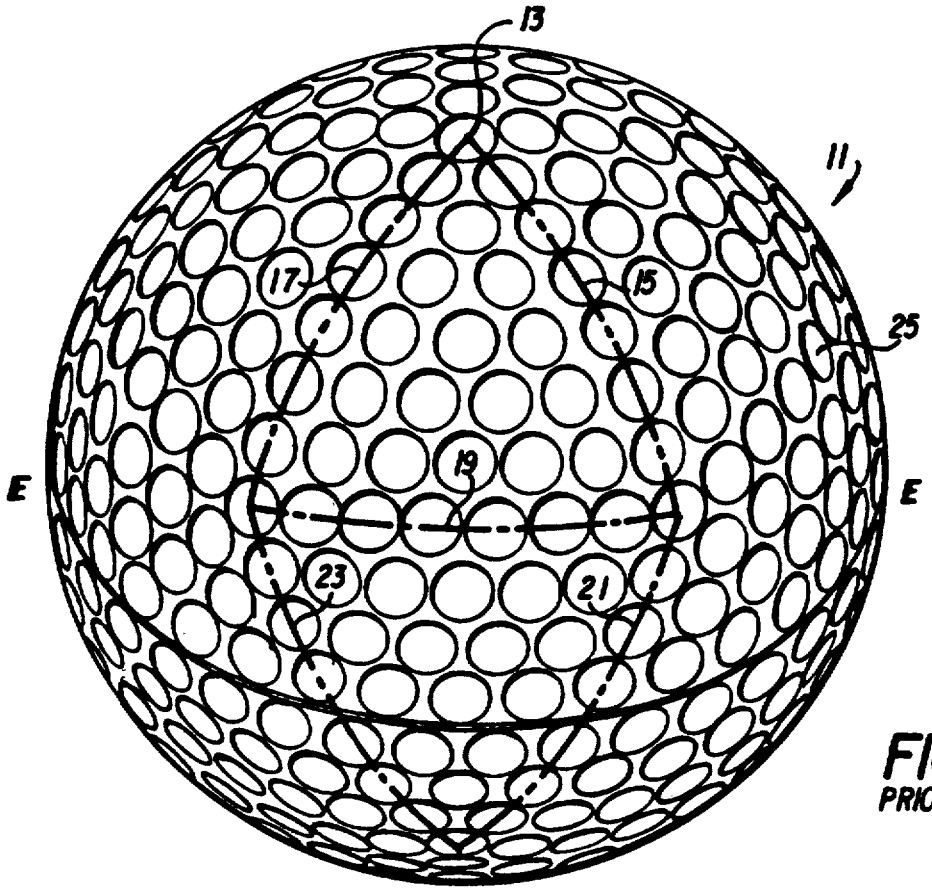
FIG. 1
PRIOR ART
FIG. 2
PRIOR ART
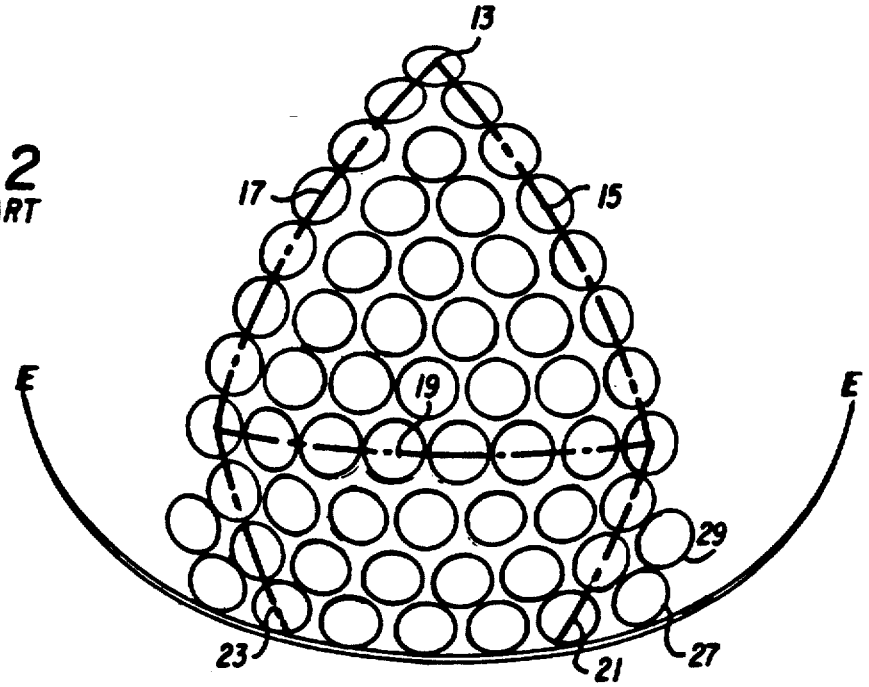

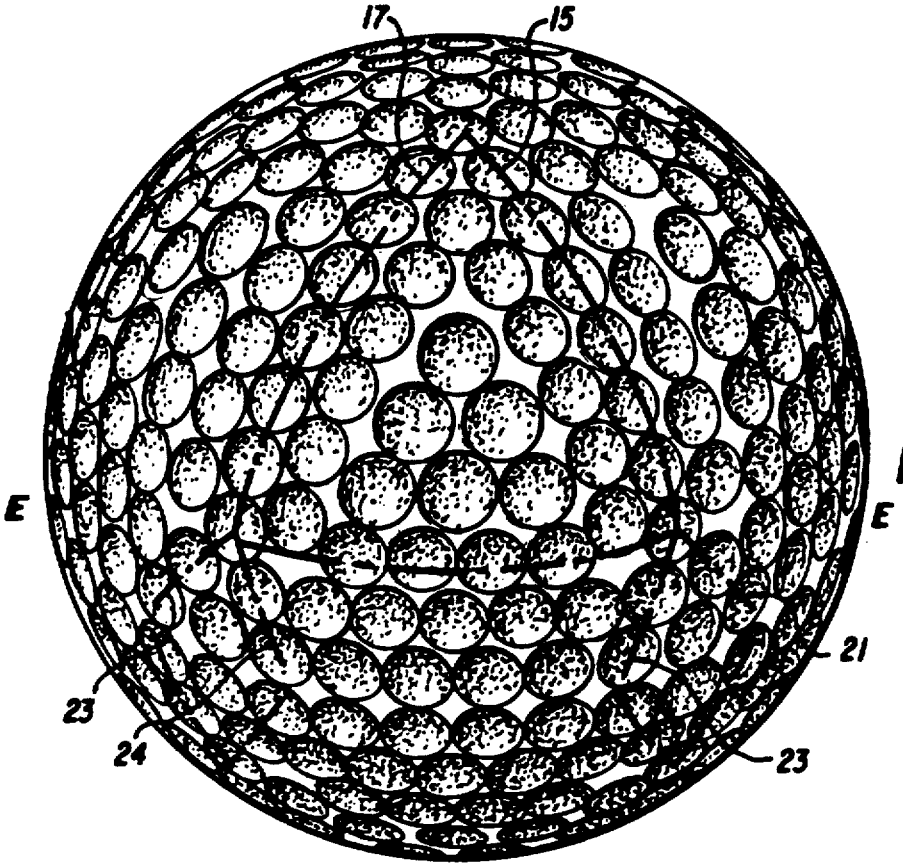
FIG. 9
FIG. 6
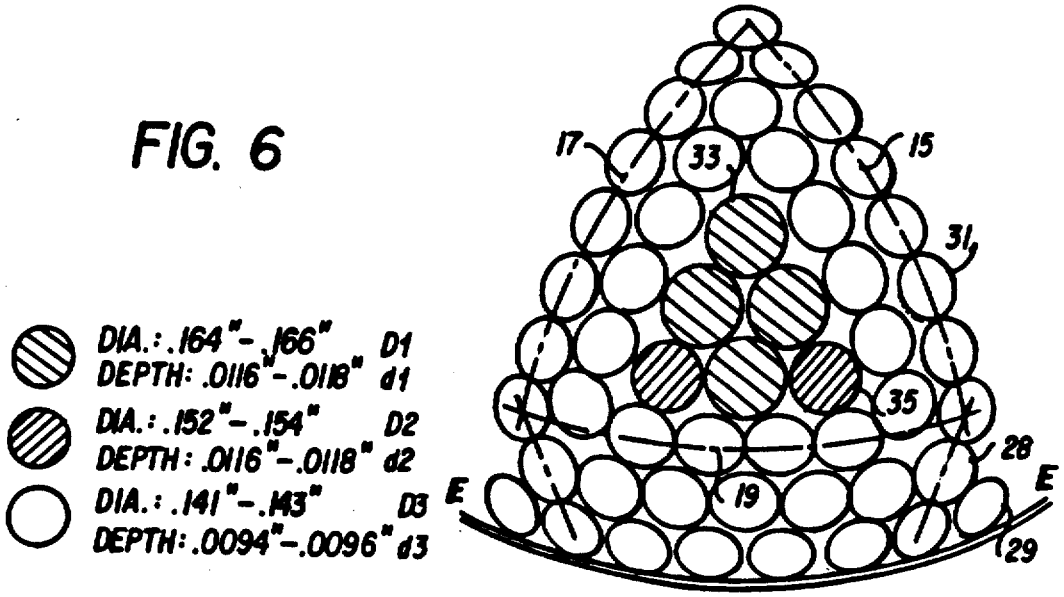

GOLF BALL

This invention relates generally to golf balls and more particularly to a specific arrangement of the dimples on a golf ball.

It is generally known that for any given selected number of dimples on a golf ball, it is desirable that the area of the surface of the golf ball covered by the dimples be a maximum in order to provide the best flight characteristics for a golf ball. In British Patent Provisional Specification Ser. No. 377,354, filed May 22, 1931, in the name of John Vernon Pugh, there is disclosed the fact that by the use of an icosahedral lattice for defining dimple patterns on a golf ball it is possible to make a geometrically symmetrical ball. This icosahedral lattice is developed by the known division of a sphere or spherical surface into like areas determined by an inscribed regular polyhedron such as an icosahedron. The Pugh specification specifically details the means of plotting the icosahedron on the surface of the golf ball and, accordingly, will not be dealt with in detail here. Thus, with a selected number and size of the dimples placed in this icosahedral pattern, the area of the surface of the ball covered by the dimples is fixed.

Additionally, a problem arises with the Pugh icosahedron golf ball in that there is no equatorial line on the ball which does not pass through some of the dimples on the ball. Since golf balls are molded and manufactured by using two hemispherical half molds normally having straight edges, the ball, as it comes from the mold, has a flash line about the equatorial line created by the two hemispheres of the mold. Such molding results in a clear flash line. Even if the ball could be molded with dimples on the flash line, the ball could not be properly cleaned and finished in any efficient manner since the flash could not be cleaned from the bottom of the dimple without individual treatment of each dimple.

The Pugh ball is geometrically symmetrical. Any changes in dimple location which affect the aerodynamic symmetry under U.S.G.A. standards will render the ball illegal for sanctioned play. Many proposals have been made and balls have been constructed with a modification of the Pugh icosahedral pattern so as to provide an equatorial line which is free of dimples.

U.S.G.A. rules of golf require that the ball shall be designed and manufactured to perform in general as if it were aerodynamically symmetrical. A golf ball which is dimpled in some manner may be geometrically symmetrical and not aerodynamically symmetrical. A perfect example of a golf ball which is both geometrically symmetrical and aerodynamically symmetrical is a smooth sphere. As is well known, this ball is not capable of providing the necessary performance required in present day golf. To conform, all balls must be aerodynamically symmetrical. This symmetry is determined by actual tests of the ball as it is being struck by a machine which belongs to the U.S.G.A.

The assignee corporation of the present invention is manufacturing an aerodynamically symmetrical golf ball including a patterned outer surface having 492 dimples arranged in 20 triangles based upon an inscribed modified icosahedral lattice on the surface of the ball. A predetermined spacing is provided between two rows of in-line dimples on opposite sides of a preselected equatorial line about the ball, the equatorial line being created by the modification of the icosahedral lattice on the surface of the ball through adjustment of the vertices of the triangles and associated arcs. This particular golf ball is the subject matter of U.S. patent application Ser. No. 07/335,348, filed Apr. 10, 1989, and is assigned to the assignee of the present invention. While this golf ball has been widely accepted and is favored by some golfers due to the particular trajectory which it produces, it has not been found to be satisfactory to some golfers because of the lack of distance which is obtainable by that ball.

Accordingly, it is an object of this invention to modify the dimpled golf ball having 492 dimples so as to attain an increase in distance attained from driving the ball.

Another object of the present invention is to improve the flight characteristics of an icosahedral lattice, dimpled golf ball and modifications of such an icosahedral lattice.

A further object of this invention is to design a ball having improved flight characteristics which presents a modified icosahedral lattice while providing a substantially dimple-free equatorial line.

Yet another object of this invention is to provide a golf ball having a dimple pattern based on an icosadhedral lattice or a modification thereof and having three sets of dimples, the diameter of each set of dimples being different.

A still further object of this invention is to provide a golf ball having three sets of dimples, with the diameter of each set of dimples being different, and having opposed in-line dimples spaced on either side of an equatorial line created by the modification of an icosahedral pattern.

These and other objects of the invention will become obvious from the following description and accompanying drawings.

SUMMARY OF THE INVENTION

The present invention provides a dimpled configuration for a golf ball having a modified icosahedral lattice configuration created by 422 dimples. The lattice comprises a plurality of adjacent triangles on either side of the equator, with the vertices of each of the adjacent triangles being located at each of the poles and the legs of the triangles opposite the poles being equidistantly spaced from the equator. Each of the triangles includes four dimples having a diameter D2 and two dimples having a diameter D3. The remaining surface of the ball, including the remaining area within the triangles, contains dimples having a diameter D1. The diameter relationship is $D1 > D2 > D3$.

BRIEF DESCRIPTION OF THE DRAWINGS

FIG. 1 is a view of a prior art ball having 492 dimples, with the ball being viewed showing both the pole and the equator of the ball;

FIG. 2 is a schematic showing of one section of the ball of FIG. 1;

FIGS. 3–6 are schematic illustrations of the modification of the dimples of the ball of FIG. 1 which obtain the ball of the present invention;

FIG. 9 is a view of the ball of FIG. 1 showing both a pole and the equator.

DETAILED DESCRIPTION OF THE INVENTION

Figure 3:
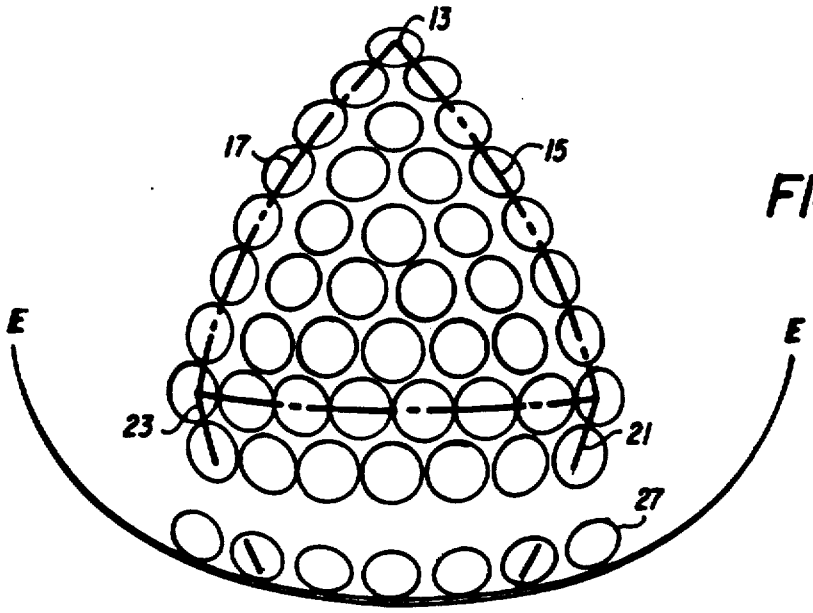

FIG. 1 illustrates a ball of the prior art having 492 dimples, the dimples being arranged in a modified icosahedral pattern. In this particular ball, all dimples are of the same diameter, which is substantially 0.126 inch.

FIG. 2 is a section of the ball of FIG. 1 showing one of the icosahedral triangles and part of another of the triangles above equator E—E. The lattice work is shown which forms the various triangles, such as the triangle having legs 15, 17, and 19 with a lower triangle extending downwardly and past the equator consisting of legs 21, 23, and 19. As shown in FIG. 2, three rows of dimples extend about the ball between equator E—E and the triangle having legs 15, 17, and 19. One row of dimples 27 is adjacent the equator, while a second row of dimples 29 is immediately above and adjacent to rows of dimples 27.

FIGS. 3–6 illustrate the steps taken in modifying the ball having 492 dimples to obtain the ball of the present invention, which has 422 dimples. The first step in the modification of the ball is shown in FIG. 3, wherein the row of dimples 29, FIG. 2, has been removed from the ball, leaving a space above the row of dimples 27 adjacent the equator. It is to be understood that this same row of dimples is removed from the opposite side of the equator. This results in the removal of 35 dimples from each side of the equator.

Figure 4:
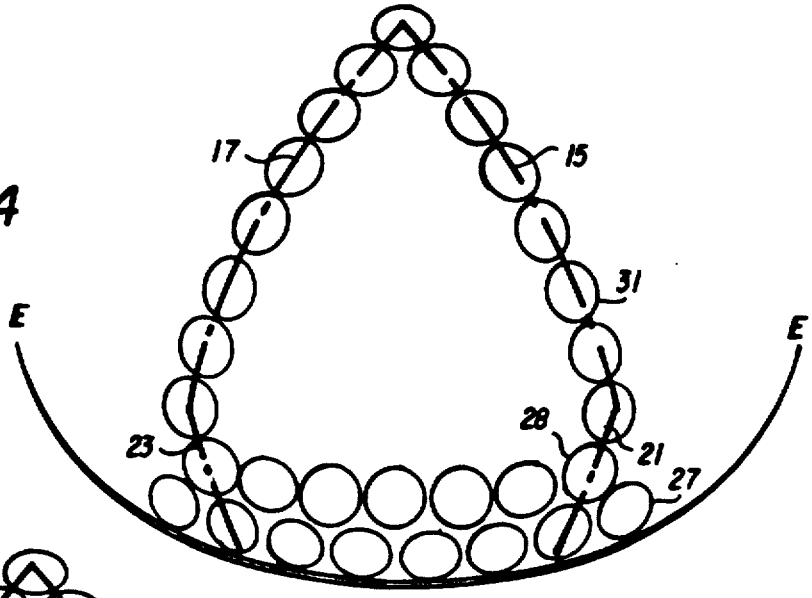

The next step of modification is illustrated in FIG. 4, wherein dimples within the triangles formed by the lattice are removed and the outer edges of all of the dimples are expanded so as to increase the diameter thereof to a diameter of approximately 0.141 to 0.143 inch. This increase in diameter brings the dimples forming the lattice work of the triangle and the dimples in the two rows adjacent equator E—E into contact.

Figure 5:
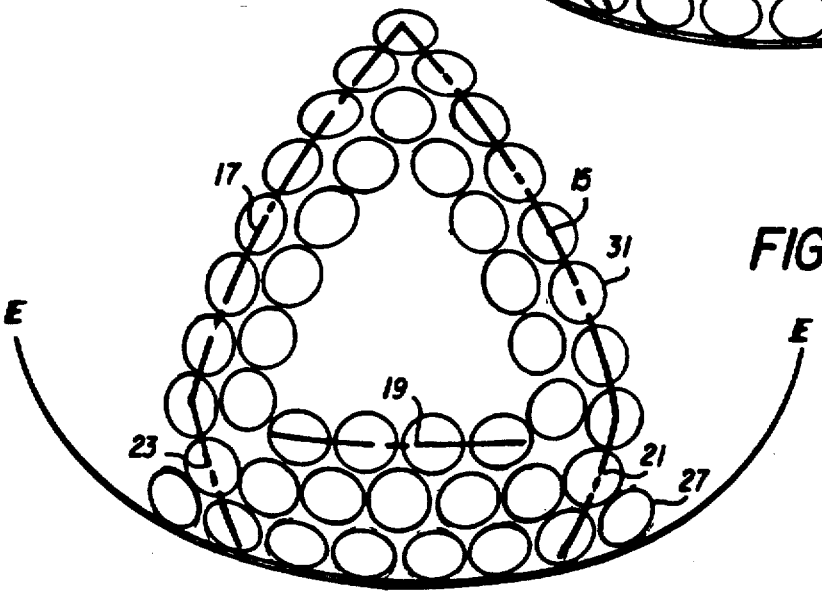

In next step of modification, as shown in FIG. 5, the interior of the triangle formed by legs 15, 17, and 19 is filled with dimples 31 adjacent the dimples along the lattice work. These dimples 31 have substantially the same diameter of 0.141 to 0.143 inch.

This leaves an area within the interior of each of the triangles which must be filled by dimples. As is well known, it is desirable to cover as much of the surface of the ball as possible with dimples.

FIG. 6 is a graphic illustration of such a dimple configuration according to the present invention. All the dimples lying along the lattice lines as indicated in the drawings are of a diameter D3. Within each triangle there are four dimples 33 having a diameter D1 and two dimples 35 having a diameter D2. The remaining dimples 31 lying within the triangle have a diameter D3, as do all of the remaining dimples on the surface of the golf ball. In the configuration shown, the lower of dimples 33 lies adjacent the dimples along leg 19 of the lattice, with the two central dimples 33 being side-by-side above the lower dimple. The upper of the dimples 33 lies directly above the lower dimple and is adjacent the central dimples. Dimples 35 lie adjacent the dimples along leg 19 and the lower of the dimples 33. Thus, dimples 33 and 35 are substantially centrally located within the triangle formed by legs 15, 17, and 19.

The four dimples 33 have a diameter D1 of substantially 0.164 to 0.166 inch, while the two dimples 35 have a diameter D2 of substantially 0.152 to 0.154 inch and the diameter D3 of the remaining dimples is substantially 0.141 to 0.143 inch. In the ball as illustrated, the depth d1 and d2 of dimples 33 and 35 is substantially 0.0116 to 0.0118 inch, while the depth d3 of all the remaining dimples is substantially 0.0094 to 0.0096 inch.

Figure 7:
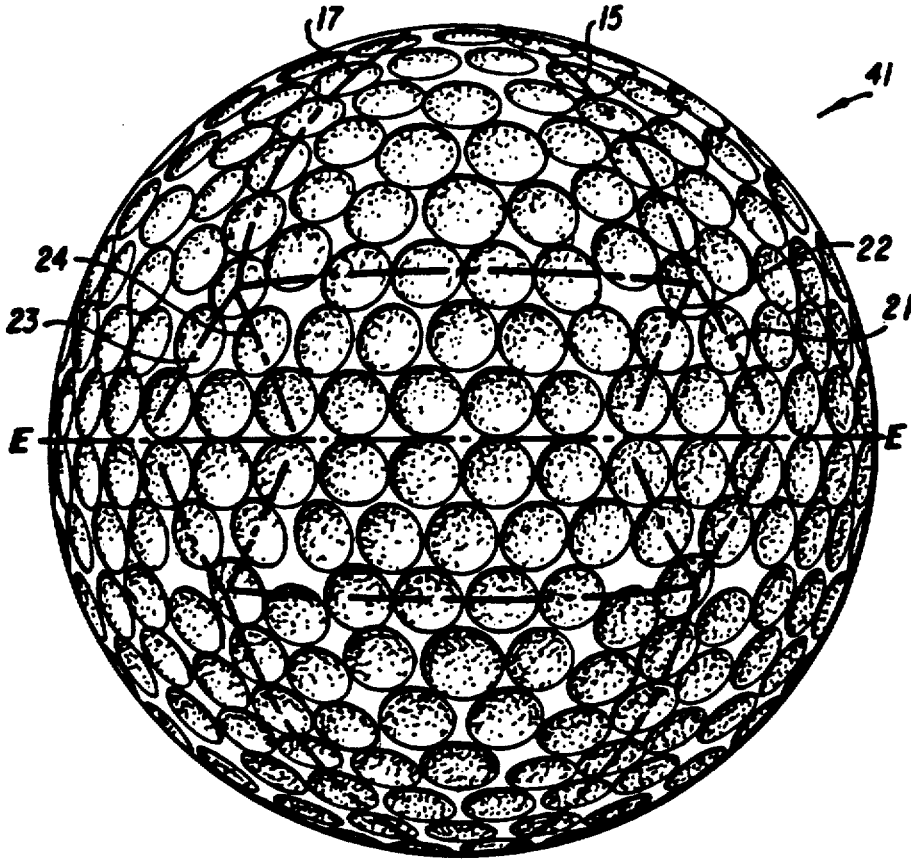
FIG. 7 is a side view of the golf ball of the present invention as viewed along the equator.
Figure 8:
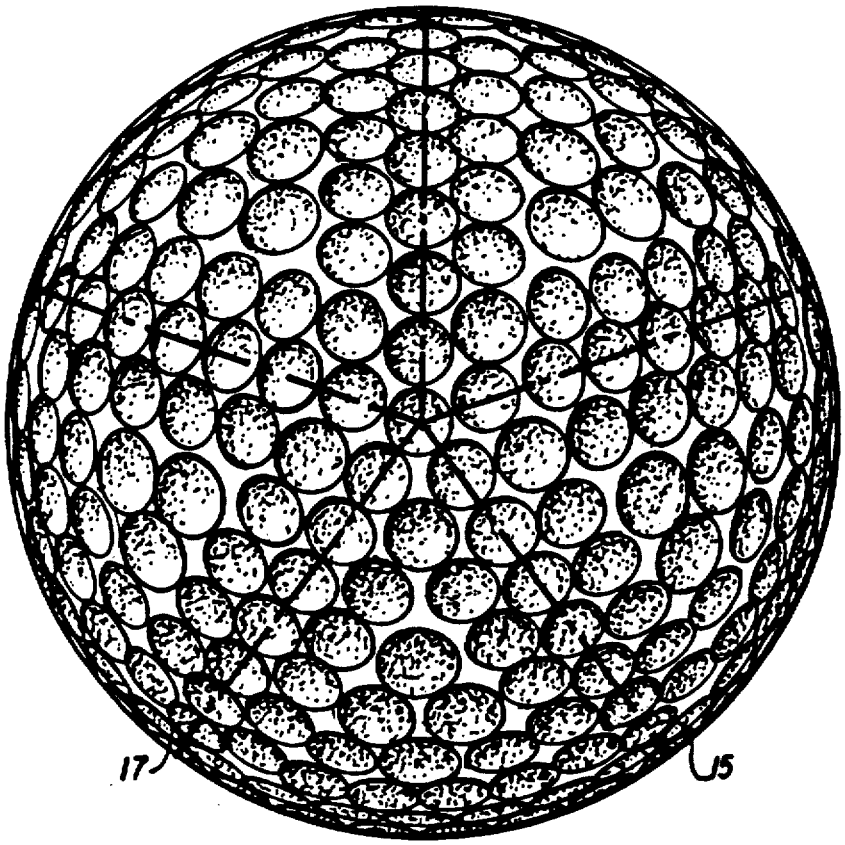
FIG. 8 is a plan view of the ball of FIG. 1 as viewed at one of the poles.

FIG. 7 is a plan or equatorial view of a golf ball wherein the equator E—E extends centrally across the figure, FIG. 8 is a plan view looking down on one of the poles of the golf ball, and FIG. 9 is a view taken at an angle between the views of FIG. 7 and FIG. 8.

Referring to FIGS. 7, 8, and 9, ball 11 is disclosed having a lattice formed by the dimples on the surface of the ball. The lattice includes five triangles on either side of the equator, with the triangles being formed by lattice 15, 17, and 19 for each triangle and the vertices of the triangles terminating at pole 13.

Each of the legs 19 of the triangles is equidistantly spaced a predetermined distance from equator E—E. The equator forms the dimple-free flash line during the molding process. Legs 21, 22, 23, and 24 extend from vertices formed with leg 19 towards the equator to form smaller triangles, as shown. It is noted that this pattern is consistent about the surface of the ball. The lattice lines as shown in the drawings represent the modified icosahedral triangle configuration formed by the dimples on the ball. It is to be understood that the opposite sides of the ball from the equator are mirror images of each other and the discussion, accordingly, will relate only to the dimples on one side of the equator, with the understanding that it is applicable to the opposite side of the equator.

As will be obvious from the above description, the majority of the dimples used on the ball of FIGS. 7, 8, and 9 have the same diameter and dimple depth. The exception resides in the dimples within each of the triangles created by the lattice structure.

In the area between legs 19 and equator E—E there are two rows of dimples 27 and 28 which extend about the entire surface of the ball. Dimples 27, which are closest to the equator, are in direct opposition to the equivalent dimples on the opposite side of the equator. As previously indicated, these dimples have a diameter D3.

In the ball as illustrated, the diameter (D) and depth (d) of the dimples are as follows:

| | | | |
|---|---|---|---|
| D1 | 0.164"–0.166" | d1 | 0.0116"–0.0118" |
| D2 | 0.152"–0.154" | d2 | 0.0116"–0.0118" |
| D3 | 0.141"–0.143" | d3 | 0.0094"–0.0096" |

The total number of dimples on the ball is 422, with 362 dimples having a diameter D3, 40 dimples having a diameter D1, and 20 dimples having diameter D2.

EXAMPLE

The following standard USGA test shows the results obtained by the ball having 492 dimples and the ball of the present invention having 422 dimples:

| BALL | RELATIVE TRAJECTORY | FLIGHT TIME (SECONDS) | CARRY (YARDS) | DEVIATION FOR C/L (YARDS) | ROLL (YARDS) | TOTAL (YARDS) |
|---|---|---|---|---|---|---|
| 492 | 13.3 | 6.1 | 252.9 | −7.4 | 8.2 | 261.1 |
| 422 | 13.2 | 6.4 | 260.9 | −5.5 | 10.3 | 271.2 |

Balls were hit with a standard driver using a mechanical golfer. The drive club head speed was 160 feet per second.

As will be obvious, the ball of the present invention was longer than the 492 ball by over 10 yards, which is a very substantial increase.

The above description and drawings are illustrative, only, and the invention is to be limited only by the scope of the following claims.

We claim:

1. A golf ball having two poles and an equator, and having a preselected number of dimples arranged in a geometrical lattice configuration based upon a modified icosahedral lattice, said lattice comprising a first plurality of adjacent triangles on either side of the equator of the ball, with the vertices of each of the adjacent triangles being located at each pole of said ball and the legs of said adjacent triangles opposite the vertices of said triangle being equidistantly spaced a predetermined distance from the equator of said ball;

two adjacent rows of dimples on either side of the equator of said ball extending about said ball between said equator and said legs of said triangles opposite said vertices, said dimples in said two adjacent rows having a diameter D3;

a first plurality of dimples lying along the lattice lines of said triangles, said first plurality of said dimples having a diameter D3;

a second plurality of dimples lying within each of said triangles, said second plurality of dimples comprising four dimples having a diameter D1 greater than diameter D3;

two dimples having a diameter D2 greater than diameter D3, but less than the diameter D1; and the remaining dimples lying in said triangles having a diameter D3.

2. The golf ball of claim 1 wherein there are five adjacent triangles on either side of the equator of the ball.

3. The golf ball of claim 1 wherein the ball has 422 dimples and the diameters of said dimples are:

| | |
|---|---|
| D1 | 0.164–0.166 Inch |
| D2 | 0.152–0.154 Inch |
| D3 | 0.141–0.143 Inch |

4. The golf ball of claim 1 wherein the ball has 362 dimples having a diameter D3, 40 dimples having a diameter D1, and 20 dimples having a diameter D2.

5. The golf ball of claim 4 wherein the depths d1, d2, and d3 of said dimples are:

| | |
|---|---|
| d1 and d2 | 0.0116–0.0118 Inch |
| d3 | 0.0094–0.0096 Inch |

6. The golf ball of claim 1 wherein said four dimples having a diameter D1 and said two dimples having a diameter D2 are located substantially centrally within said triangles.

* * * * *